United States Patent [19]

Berry

[11] 4,328,863

[45] May 11, 1982

[54] IN SITU RETORTING OF OIL SHALE

[75] Inventor: Kay L. Berry, Denver, Colo.

[73] Assignee: Standard Oil Company (Indiana), Chicago, Ill.

[21] Appl. No.: 130,551

[22] Filed: Mar. 14, 1980

[51] Int. Cl.[3] ..... E21B 43/247

[52] U.S. Cl. ..... 166/261; 166/259

[58] Field of Search ..... 166/259, 256, 260, 261; 299/2, 11

[56] References Cited

U.S. PATENT DOCUMENTS

| | | | |
|---|---|---|---|
| 2,793,696 | 5/1957 | Morse | 166/256 |
| 2,958,380 | 11/1960 | Schild | 166/256 |
| 3,127,935 | 4/1964 | Poettman et al. | 166/260 |
| 3,521,709 | 7/1970 | Needham | 166/259 X |
| 3,586,377 | 6/1971 | Ellington | 166/259 X |
| 3,661,423 | 5/1972 | Garrett | 299/2 |
| 4,036,299 | 7/1977 | Cha | 166/259 X |

*Primary Examiner*—Stephen J. Novosad

*Attorney, Agent, or Firm*—Thomas W. Tolpin; William T. McClain; William H. Magidson

[57] ABSTRACT

Disclosed is a method for the underground retorting of oil shale comprising introducing retorting fluid from a first direction into a retort containing rubblized mass comprising oil shale until the mass is substantially retorted; and then introducing oxygen containing gas from a second direction substantially opposite to the first direction to combust with coke or hydrocarbonaceous materials in the rubblized mass and retort a portion of unretorted rubblized mass.

12 Claims, 1 Drawing Figure

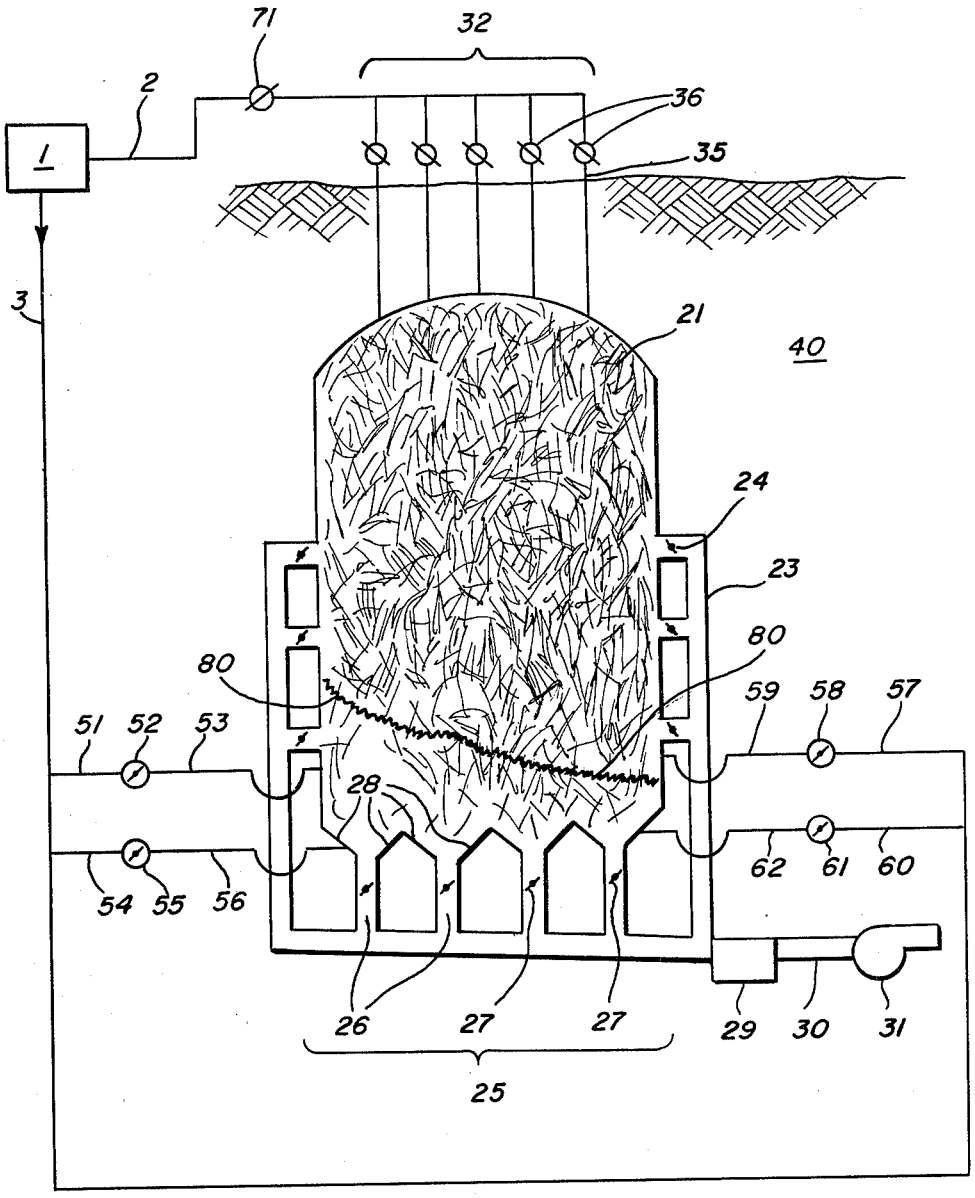
71
32
2
36
1
35
3
21
40
24
23
80
80
59
58
57
51
52
53
28
62
61
60
54
55
56
26
27
27
29
30
31
25

IN SITU RETORTING OF OIL SHALE

BACKGROUND

This invention relates to recovery of carbonaceous materials from underground deposits. More specifically, this invention relates to the subsurface combustion and retorting of hydrocarbonaceous materials such as oil shale.

Numerous hydrocarbonaceous materials are found in underground deposits; for example crude oil, coal, shale, oil, tar sands, and others. One method of recovering energy or hydrocarbon from such underground deposits is by underground combustion. An oxidizing gas such as air can be provided to an underground combustion or retorting zone so as to combust a portion of the combustible material contained therein and free hydrocarbon or thereby form materials which are suitable for energy recovery. For example, air or oxygen, and diluent gases such as steam, can be passed into a coal deposit so as to form off-gases having combustible materials such as light hydrocarbons and carbon monoxide. These gases can then be combusted directly for heat, or energy recovered such as through power generation. Underground combustion can be used in the recovery of petroleum crude oil from certain types of deposits. Air or oxygen, and steam, is passed into an underground deposit and combustion initiated so hot combustion gases will aid in the recovery of such crude oil. Similar technique can be used in the recovery of oil from tar sands. One important use of underground combustion is in the recovery of oil from oil shale.

The term "oil shale" refers to sedimentary deposits containing organic materials which can be converted to shale oil. Oil shale can be found in various places throughout the world, especially in the United States in Colorado, Utah, and Wyoming. Some especially important deposits can be found in the Green River formation in the Piceance Basin, Garfield and Rio Blanco counties, in Northwestern Colorado.

Oil shale contains organic material called kerogen which is a solid carbonaceous material from which shale oil can be produced. Commonly oil shale deposits have variable richness or kerogen content, the oil shale generally being stratified in horizontal layers. Upon heating oil shale to a sufficient temperature, kerogen is decomposed and liquids and gases are formed. Oil shale can be retorted to form a hydrocarbon liquid either by in situ or surface retorting. In surface retorting, oil shale is mined from the ground, brought to the surface, and placed in vessels where it is contacted with hot retorting materials, such as hot shale or gases, for heat transfer. The hot retorting solids or gases cause shale oil to be freed from the rock. Spent retorted oil shale which has been depleted in kerogen is removed from the reactor and discarded. Some well known methods of surface retorting are the Tosco, Lurgi, and Paraho processes and fluid bed retorting.

Another method of retorting oil shale is the in situ process. In situ retorting of oil shale generally comprises forming a retort or retorting zone underground, preferably within the oil shale zone. The retorting zone can be formed by mining an access tunnel to or near the retorting zone and then removing a portion of the oil shale deposit by conventional mining techniques. About 2 to about 45 percent, preferably about 15 to about 40 percent, of the oil shale in the retorting area is removed to provide void space in the retorting area. The oil shale in the retorting area is than rubblized by well-known mining and blasting techniques to provide a retort containing rubblized shale for retorting. In some cases it is possible to rubblize underground oil shale without removal of a portion of the oil shale. However, it is generally preferable to remove material so as to provide void space which will result in more uniform rubblization and more efficient use of explosives.

A common method for forming the underground retort is to undercut the deposit to be retorted and remove a portion of the deposit to provide void space. Explosives are then placed in the overlying or surrounding oil shale. These explosives are used to rubblize the shale, preferably forming a zone of rubble having uniform particle size and void spaces. Some of the techniques used for forming the undercut area and the rubblized area are room and pillar mining, sublevel caving, crater retreat and the like. Because of the stratification of oil shale it may be desirable to selectively mine material based on its mineral or kerogen content for removal from the retorting zone. Also because of the stratification, the retorting zone may contain lean oil shale, or rock containing essentially no kerogen. After the underground retort is formed, the pile of rubblized shale is subjected to retorting. Hot retorting gases are passed through the rubblized shale to effectively form and recover liquid hydrocarbon from the oil shale. This can be done by passing a gas comprising air or air mixed with steam through the deposit. Air can be forced into one end of the retort and a fire or flame front initiated. Combustion can be initiated by introducing fuels such as natural gas, propane, shale oil, and the like which are readily combustible with air. After combustion has been initiated, it can be sustained by combusting coke on spent or partially spent oil shale, oxygen contacting the coke forming or maintaining a flame front. This flame front is then passed slowly through the rubblized deposit to effect retorting. Actually the hot combustion gases passing ahead of the flame front cause the retorting of oil shale and the formation of shale oil. Another suitable retorting fluid comprises hot combustion or retorting off-gas from the same or nearby underground retort. Not only is shale oil effectively produced, but also a mixture of off-gases is produced during retorting. These gases contain hydrogen, carbon monoxide, ammonia, carbon dioxide, hydrogen sulfide, carbonyl sulfide, oxides of sulfur and nitrogen, and low molecular weight hydrocarbons. Generally a mixture of off-gases, water and shale oil are recovered from the retort. This mixture undergoes preliminary separation commonly by gravity to separate the gases from the liquid oil from the liquid water. The off-gases commonly also contain entrained dust, and hydrocarbons, some of which are liquid or liquefiable under moderate pressure. The off-gases commonly have a very low heat content, generally about 50 to about 150 BTU per cubic foot.

A number of patents describe methods of in situ retorting of oil shale, such as Karrick, L. C., U.S. Pat. No. 1,913,395; Karrick, S. N., U.S. Pat. No. 1,919,636; Uren, U.S. Pat. No. 2,481,051; Van Poollen, U.S. Pat. No. 3,001,776; Ellington, U.S. Pat. No. 3,586,377; Prats, U.S. Pat. No. 3,434,757; Garrett, U.S. Pat. No. 3,661,423; Ridley, U.S. Pat. No. 3,951,456; and Lewis, U.S. Pat. No. 4,017,119 which are hereby incorporated by reference and made a part hereof. These references teach both up-flow and down-flow vertical retorts. Both up-flow and down-flow retorting is discussed in

*Liquid Product From Bottom Burn Shale Retort,* Richard C. Aiken, University of Utah (1979).

One problem in the underground combustion and retorting of carbonaceous materials such as shale oil deposits is the difficulty in forming and maintaining a uniformly oriented or even flame front. If a portion of the flame front advances more quickly than other portions, large portions of the rubblized matter will be bypassed and will not be effectively retorted, thereby diminishing overall recovery of energy from the deposit. This is partially attributable to the difficulty in forming a uniform rubblized mass with uniform gas passages, and also uniformly passing gas into and out of the retorting area. If a narrow portion of the flame front advances completely through the retorting area, high temperature and/or oxidizing gas which is passed into one end of the retort will eventually break through the flame front at the leading position and pass to the off-gas collection system (breakthrough). This will overload the off-gas collection system with oxidizing gas which has not had an opportunity to partake in the combustion process. Therefore, flame front breakthrough can lead to the termination of retorting of an oil shale retort before all of, or even a substantial portion of, the rubblized mass of oil shale is retorted, thereby lowering energy recovery from a retort. Flame front breakthrough can also be dangerous because it can result in a combustible or explosive gas composition in the product recovery zone.

It is an object of this invention to provide a process for the efficient recovery of energy from underground deposits of hydrocarbon so that higher yields of energy can be recovered from a given deposit.

It is an object of this invention to prevent the overloading of off-gas recovery systems attendant to underground combustion processes and to prevent dangerous gas compositions in off-gas recovery systems.

It is an object of this invention to retort substantially all of the rubblized oil shale within a retort, thereby maximizing energy recovery.

SUMMARY OF THE INVENTION

The objects of this invention can be attained by a method for the underground retorting of oil shale comprising passing retorting fluid from a first direction through a retort containing rubblized mass comprising oil shale until the mass is substantially retorted; and then passing oxygen containing gas from a second direction substantially opposite to the first direction to combust with coke or hydrocarbonaceous materials in the rubblized mass and retort a portion of unretorted rubblized mass. The gas from the second direction causes retorting of oil shale and the formation of shale oil and/or gases having heating value. This process increases total energy recovery from a retorting zone by higher hydrocarbon and carbon monoxide recovery.

The underground retorts can be horizontal or vertical, and of various shapes such as rectangular, cylindrical, elongated, or irregular. Retorting fluid can be passed into such retort in any direction such as upward, downward, sideways or transversely. It is preferred to use a vertical retort with hot retorting gases passed predominantly in a downward direction so that shale oil formed, often in mist form, and also coalesced oil on rubble, can pass essentially downwardly aided by gravity and gas flow.

Retorting fluid is passed from a first direction until the rubblized mass comprising oil shale is substantially retorted. It is preferable to first retort as much of the oil shale as possible, at least 50 weight percent, from a first direction in a normal retorting operation. After at least 50 weight percent, more preferably at least 70 weight percent, of the oil shale is retorted, oxygen containing gas is passed from a second direction to retort a portion of the unretorted oil shale. By such retorting, the position of the flame front can be modified so as to prevent break-through and bypassing of resourse by the flame front. Even if break-through occurs, retorting by passing oxygen containing gas from the second direction will recover hydrocarbon values from the resourse which would have been by-passed.

Retorting from the first direction can be terminated when the flame front advances irregularly, such as becoming nonplanar, or nonperpendicular to the direction of gas flow, or at or near flame front break-through.

Position or disposition of flame fronts are preferably detected by use of thermocouples, however other techniques and apparatus are described in McCollum, U.S. Ser. No. 925,178, now U.S. Pat. No. 4,199,026; Ginsburgh, et al., U.S. Ser. No. 925,176, now U.S. Pat No. 4,210,867; and Ginsburgh, et al., U.S. Ser. No. 925,177, now U.S. Pat. No. 4,210,868, all filed July 17, 1978, and all which are hereby incorporated by reference and made a part hereof.

The second direction is substantially opposite to the first direction. For example, if the first direction is downward, the second direction is substantially upward through the rubblized mass. In most cases, oxygen containing gas or retorting fluid is first passed to a retorting zone from a first side of such retorting zone, and then oxygen containing gas is passed to such retorting zone from the opposite side of such retorting zone.

In one type of underground in situ retort, an essentially planar flame front is initiated across a retorting zone containing rubblized mass comprising oil shale. The flame front is advanced partially across the retorting zone by introduction of oxygen containing gas into such zone from a first direction. Introduction of gas from the first direction is terminated before all the oil shale is retorted, and oxygen containing gas is introduced into the retorting zone from a second direction substantially opposite to the first direction to effect retorting of oil shale. Higher recovery of shale oil from the retorting zone is achieved because substantially all of the rubblized oil shale within the zone is retorted and absorbed oil driven off.

The oxygen containing gas comprises air, oxygen, combustion gases, or mixtures thereof. Preferably the gas also comprises steam so as to increase its heat capacity and help control flame front and retorting temperature.

Oxygen containing gas is introduced in the first direction at a rate of about 1.0 to about 10, preferably about 2 to about 6, SCF/min./$ft^2$ superficial velocity in regard to retort cross-sectional area and gas is introduced in the second direction at a rate of about 0.1 to about 1.0 SCF/min./$ft^2$. (SCF is standard cubic feet).

In vertical underground in situ retorting of oil shale the process can comprise introducing retorting fluid near the top of a retort containing rubblized mass comprising oil shale to form a retorting zone, and passing such fluid essentially downwardly so as to effectively retort a portion of the mass and advance the retorting zone downwardly. The introduction of retorting fluid near the top of the retort is discontinued and then oxygen containing gas can be introduced near the bottom of the retort. The oxygen containing gas is passed substantially upwardly so as to effectively retort a portion of the mass.

In a typical vertical retort shale oil can be recovered near the bottom of the retorting zone. The oxygen containing gas can be passed substantially upwardly at a slow rate so as to minimize the amount of produced shale oil passing upwardly onto hot spent shale, commonly a rate of about 0.1 to about 1.0 SCF/min./ft$^2$.

THE DRAWING

The attached drawing is a schematic diagram of an in situ retort exemplifying one embodiment of this invention.

Underground in situ retort 20 is an elongated rectangular vertical retort positioned within oil shale bed 40. Underground retorts are generally first constructed by limited removal of a portion of the oil shale deposit followed by rubblization. The underground cavity which generally defines the retort is substantially filled with a rubblized mass of oil shale. Communication is provided to the retort for the introduction of fluids which comprise retorting fluids or will form retorting fluids within the retort. Communication is also provided from the retort for the removal of liquid and gaseous products therefrom. This particular retort is designed to have gases passed into the top of the retort and other gases and liquids removed from near the bottom of the retort. Gases 1 to initiate or support in situ combustion are passed through line 2 to a manifolding area 32. Valves 71 and 36 control the flow of gas through passages 35 in the manifolding area. The gases can then be passed through holes or passages into and through rubblized mass 21 comprising oil shale. These holes can be drilled from the ground surface or from a drift near the top of the retort.

Gases can be removed from the retort via passageways 23 which have been mined in the formation immediately adjacent to the retort 20 and which are in communication therewith. Valves 24 are used to control the flow of gases from the retort into the passageways 23 for collection in the manifolding system 25. Liquid products from the retorting zone generally accumulate at the bottom of the retort because of gravity and because of gas flow in a downward direction, and pass along the sloping floors 28 of the retort through mined tunnels 26 and pass along a sloping floor in such tunnels to sump 29 where such liquids are collected. Commonly these liquids comprise hydrocarbon and water which are then separated for recovery or disposal. Gases can also be collected through tunnels 26 and gas flow can be controlled by valves 27 in such tunnels to control the removal of gases from the retort. Oxygen-containing gas 1 to support combustion can be provided via line 3 to line 51, valve 52, and line 53; to line 54, valve 55, and line 56; to line 57, valve 58, and line 59; line 60, valve 61, and line 62; so as to provide oxygen-containing gases at various points in the bottom of the in situ retort to support combustion and retorting.

Prior to the commencement of retorting, a heating fluid can be passed into the cavity to heat a portion of rubblized mass to a temperature in excess of the shale oil pour point without substantial retorting of the oil shale. It is desirable to heat a portion of the rock or oil shale so as to prevent the agglomeration of oil from retorting on cool rock or oil shale. It is desirable to heat such rock without substantial retorting so that little or no shale oil is produced during such preheating. This can be accomplished by maintaining the temperature of the oil shale less than about 200° C. However, short-term transient temperatures in excess of 300° C. can be tolerated. The rock or oil shale is heated to a temperature in excess of the pour point of the shale oil which will later be produced in such retort, generally to a temperature in excess of 25° C., preferably to a temperature in excess of about 35° C.

The heating fluid commonly comprises hot air, combustion off-gases, carbon dioxide, and steam, or mixtures thereof. Preferably steam is used because of its low cost, high efficiency, and availability on site. Steam which is introduced into the rubblized mass of oil shale will contact and condense on the cool oil shale or rock, thereby warming it. As the oil shale or rock warms, the steam will pass beyond such warm rock to the ajacent zone of cool rubblized mass wherein the steam will condense thereon. In this manner the rock or oil shale is efficiently heated to the appropriate temperature without undue heating and possible formation of shale oil. Condensed steam or water can later be collected with other water in the product recovery system.

A stoichiometric ratio of air to fuel is used to combust the start up fuel. Water or steam quench is used to control the temperature of the resultant inert gas in the range of 500° to 1600° F., preferably about 1000° F. After the top layer of shale has been heated to a depth of about 2 to 20 feet, the inert gas burner is turned off and a mixture of air and steam is used to begin combustion of the hot retorted shale.

Commonly, oil shale in situ retorts are elongated vertical cavities wherein air is introduced near the top of such cavity for in situ combustion and gaseous and liquid products are removed near the bottom. After such a retort is formed containing a mass of rubblized oil shale, heating fluid is passed into the retort near the top so as to heat a sufficient portion of the oil shale or rock present. Commonly at least about 2 weight percent of the volume of rubblized mass of oil shale is heated to a temperature in excess of the shale oil pour point. Preferably at least 5 weight percent of the volume of rubblized mass of oil shale is so heated. The amount of the rubblized mass that requires heating is dependent on retort configuration, oil shale richness, retorting rate, and particle size. Subsequent to such heating, the rubblized mass near the top is ignited and combustion supported by the introduction of air, air/steam, air/diluent gases, and the like. Such combustion forms hot gases which effectively retort oil shale forming shale oil. Alternatively, hot retorting fluids can be provided by the hot off-gases from a nearby in situ oil shale retort. The oil formed by retorting passes through the rubblized mass of oil shale, most often downwardly, and contacts the rock which has been previously heated to above the shale oil pour point. Because such oil shale or rock has been preheated the oil tends not to agglomerate on such rock but rather passes downwardly. The hot retorting gases advance more rapidly than the liquid moving downwardly in the retort and effectively warm the rubblized mass of oil shale below the area previously preheated. Therefore it can be seen that the entire retort need not be preheated to above the shale oil pour point but only that portion nearest the initial area of retorting.

As retorting proceeds, flame front 80 begins to become nonplanar, the right side of such flame front advancing more rapidly than the left side. As oxygen-containing gas is continually passed into retort from the top, the flame front will continue to advance downwardly in this irregular manner, eventually causing the flame front to breakthrough the rubblized matter at the right side of the retort causing oxygen-containing gases to pass directly to the product recovery zone. After the flame front or high temperature has broken through, or more preferably when the flame front becomes substantially nonplanar prior to breakthrough, the passage of oxygen-containing gas from the top of the retort is terminated. Oxygen-containing gas is then passed through line 3 to any or all of lines 51, 54, 57, and 60 so as to provide oxygen-containing gas at any point of the bottom of the retort. In this case where the left side of the flame front is lagging behind the right side, it would be desirable to introduce oxygen-containing gases through line 51, valve 52, and line 53 so as to provide oxygen at a slow rate to the lagging portion of the flame front thereby causing enhanced combustion and the advancement of that portion of the flame front receiving oxygen. It may be desirable to remove the off-gases of combustion so as to maintain a pressure balance within the retort from any one of a number of positions, for example, by opening the valves 24 immediately above the flame front where oxygen is being provided or by drawing off through suction at the top of the retort. In this case, the oxygen-containing gas will be provided through line 53 and combust with coke and hydrocarbonaceous material at or near the flame front and cause the flame front to slowly progress downwardly toward the source of the oxygen. Off-gases from such combustion will pass upwardly through valves 24 and into passageways 23 to off-gas product recovery. After the flame front progresses to near the entrance of line 53 into the retort, valve 52 can be closed to terminate the introduction of oxygen-containing gas from this point and valve 55 can be opened so as to cause oxygen-containing gases to flow through lines 3, 54, and 56 into the retort. The position of valves 36, 24, and 27 is controlled so as to provide the proper flow of gases within the retort.

I claim:

1. An improved method for the underground in situ retorting of a rubblized mass of oil shale which increases the total hydrocarbon recovery from said oil shale, comprising the steps of:

establishing a flame front generally across a rubblized mass of oil shale in an underground retort;

advancing said flame front downwardly through a substantial portion of said rubblized mass by injecting a first flame front-supporting gas containing oxygen downwardly to said flame front from a top portion of said retort to retort said rubblized mass immediately below said flame front, said flame front becoming irregular as said flame front is advanced with an advancing portion of said flame front moving ahead of a lagging portion of said flame front;

discontinuing the injection of said first flame front-supporting gas when said advancing portion of said flame front moves a predetermined distance below said lagging portion of said flame front; and advancing said lagging portion of said flame front downwardly to a position in general coplanar alignment with said advancing portion of said flame front after the injection of said first flame front-supporting gas has been discontinued by injecting a second flame front-supporting gas containing oxygen upwardly to said lagging portion from a bottom portion of said retort to effectively retort said rubblized mass immediately below said lagging portion.

2. The method of claim 1 wherein the said second gas is injected upwardly into said lagging portion at a rate substantially slower than said first gas is injected downwardly into said flame front to assure that said lagging portion moves downwardly.

3. The method of claim 1 wherein said first and second flame front-supporting gases are selected from the group consisting of oxygen, air, oxygen diluted with combustion off gases emitted from said flame front, air diluted with said combustion off gases, oxygen diluted with steam and air diluted with steam.

4. An improved method for the underground in situ retorting of oil shale, comprising the steps of:

initiating an essentially planar flame front generally across a rubblized mass of oil shale to retort said oil shale ahead of said flame front;

advancing said flame front downstream in a first direction by feeding a first gas, containing a sufficient amount of oxygen to support said flame front, in said first direction to said flame front from a position upstream of said flame front;

terminating said feeding of said first gas in said first direction before all of said oil shale is retorted; and continuing to advance said flame front downstream in said first direction by feeding a second gas containing a sufficient amount of oxygen to support said flame front, in a second direction substantially opposite to the first direction to said flame front from a position downstream of said flame front to effect rotorting of said oil shale ahead of said flame front so that higher recovery of shale oil is achieved.

5. The method of claim 4 wherein said first and second gases are selected from the group consisting of oxygen, air, oxygen diluted with combustion gases emitted from said flame front, air diluted with said combustion gases, oxygen diluted with steam and air diluted with steam.

6. The method of claim 4 wherein said first gas is fed in the first direction at a rate of about 1.0 SCF/min./ft$^2$ to about 10 SCF/min.ft$^2$, and said second gas is fed in the second direction at a rate of about 0.1 SCF/min.ft$^2$ to about 1.0 SCF/min./ft$^2$.

7. The method of claim 4 wherein the first direction is downwardly and the second direction is upwardly.

8. The method of claim 4 wherein said first gas is terminated when the flame front becomes nonplanar or substantially nonperpendicular to the first direction.

9. An improved method for the underground in situ retorting of oil shale, comprising the steps of:

establishing a flame front generally across a rubblized mass of oil shale in an underground retort;

advancing said flame front downwardly through said rubblized mass to retort at least 50% to 70% by weight of said oil shale by passing a first flame front-supporting gas containing oxygen downwardly to said flame front from an upper portion of said retort to retort said rubblized mass immediately below said flame front;

stopping said first flame front-supporting gas after at least 50% to 70% by weight of said oil shale is retorted; and completing retorting of said rubblized mass after said first flame front-supporting gas has been stopped by continuing to advance said flame front downwardly through the remainder of said rubblized mass in response to passing a second flame front-supporting gas containing oxygen upwardly to said flame front from a bottom portion of said retort so that a higher recovery of shale oil from said rubblized mass is achieved.

10. The method of claim 9 wherein said first and second flame front-supporting gases are selected from the group consisting of oxygen air, oxygen diluted with off gases emitted during said retorting, air diluted with said off gases, oxygen, diluted with steam and air diluted with steam.

11. The method of claim 9 wherein said first flame front-supporting gas is passed downwardly to said flame front at a rate of 1 SCF/min./$ft^2$ to 10 SCF/min./$ft^2$, and said second flame front-supporting gas is passed upwardly to said flame front at a rate of 0.1 SCF/min./$ft^2$ to 1.0 SCF/min./$ft^2$.

12. The method of claim 11 wherein said first flame front-supporting gas is injected downwardly at a rate from 2 SCF/min./$ft^2$ to 6 SCF/min./$ft^2$.

* * * * *

UNITED STATES PATENT OFFICE
CERTIFICATE OF CORRECTION

Patent No. 4,328,863 Dated May 11, 1982

Inventor(s) BERRY, KAY L.

It is certified that error appears in the above-identified patent and that said Letters Patent are hereby corrected as shown below:

| Patent Column | Patent Line | |
|---|---|---|
| 6 | 16 | "ajacent" should be --adjacent-- |
| 8 | 33 | "rotorting" should be --retorting-- |
| 8 | 43 | "10 SCF/min.$ft^2$" should be --10 SCF/min./$ft^2$-- |
| 8 | 44 | "0.1SCF/min.$ft^2$" should be --0.1SCF/min./$ft^2$-- |
| 9 | 10 | "oxygen air" should be --oxygen, air-- |

Signed and Sealed this

*Twenty-sixth* Day of *April 1983*

[SEAL]

*Attest:*

GERALD J. MOSSINGHOFF

*Attesting Officer* *Commissioner of Patents and Trademarks*